US005239347A

United States Patent [19]

Onodera et al.

[11] Patent Number: 5,239,347

[45] Date of Patent: Aug. 24, 1993

[54] IMAGE FORMING APPARATUS HAVING RECORDING MATERIAL CARRYING MEMBER AND MOVABLE ASSISTING MEMBER

[75] Inventors: Shinichi Onodera, Yokosuka; Kiyoharu Tanaka; Hajime Suzuki, both of Yokohama; Koji Kimura, Tokyo, all of Japan

[73] Assignee: Canon Kabushiki Kaisha, Tokyo, Japan

[21] Appl. No.: 773,267

[22] Filed: Oct. 9, 1991

[30] Foreign Application Priority Data

Oct. 11, 1990 [JP] Japan ..... 2-274155

[51] Int. Cl.[5] ..... G03G 15/16

[52] U.S. Cl. ..... 355/274; 355/272; 355/326

[58] Field of Search ..... 355/271, 272, 274, 275, 355/326, 327, 277

[56] References Cited

U.S. PATENT DOCUMENTS

| | | | |
|---|---|---|---|
| 5,057,873 | 10/1991 | Sawai et al. | 355/271 |
| 5,084,736 | 1/1992 | Suzuki et al. | 355/271 |
| 5,086,318 | 2/1992 | Takeda et al. | 355/271 |
| 5,091,751 | 2/1992 | Inoue et al. | 355/274 |

FOREIGN PATENT DOCUMENTS

| | | | |
|---|---|---|---|
| 0069084 | 4/1986 | Japan | 355/271 |
| 0180649 | 7/1988 | Japan | 355/271 |
| 0157779 | 6/1990 | Japan | 355/274 |
| 0178686 | 7/1990 | Japan | 355/274 |

*Primary Examiner*—A. T. Grimley
*Assistant Examiner*—Robert Beatty
*Attorney, Agent, or Firm*—Fitzpatrick, Cella, Harper & Scinto

[57] ABSTRACT

An image forming apparatus includes an image bearing member; a recording material carrying member for carrying a recording material; an image transfer device for transferring an image from the image bearing member to the recording material carried on the recording material carrying member; an assisting member for assisting the recording material to be carried on the recording material carrying member, the assisting member being movable to and away from the recording material carrying member; wherein the assisting member is in contact with the recording material carrying member after completion of an image forming operation and before start of next image forming operation.

77 Claims, 4 Drawing Sheets

IMAGE FORMING APPARATUS HAVING RECORDING MATERIAL CARRYING MEMBER AND MOVABLE ASSISTING MEMBER

FIELD OF THE INVENTION AND RELATED ART

The present invention relates to an image forming apparatus such as a copying machine, a printer or the like, more particularly to an image forming apparatus in which a developed image (toner image) is transferred from an image bearing member to a recording material supported on a recording material carrying member.

A color image forming apparatus is known in which an image bearing member in the form of a cylinder or an endless belt (photosensitive drum) is rotated and is subjected to a predetermined process operation to form different color toner images, which are superposedly transferred onto a recording material supported on an image transfer drum (recording material carrying means) disposed close to the surface of the image bearing member.

The transfer drum used with such an image forming apparatus comprises, as shown in FIG. 5, a pair of coaxially arranged ring members 31*a* and 31*b*, a connecting member 31*c* for connecting the ring members and a transfer material carrying sheet 32 of dielectric material to cover the opening defined by the ring members 31*a* and 31*b* and the ring members 31*c*. The connecting member 31*c* is provided with a transfer material gripper to grip the leading end of the transfer material which is supplied in timed relation with the toner image on the image bearing member. When the transfer material brought to the image bearing member, the toner images are transferred to the transfer material, so that a color image is formed thereon. Thereafter, the gripping means is opened to permit separation of the transfer material from the transfer drum 31. Then, the transfer material is supplied to an image fixing station wherein the color images are mixed into a full-color image.

The transfer material gripping means is usually raised upon the transfer material separation to assist separation of the transfer material. Therefore, the transfer drum has a complicated and costly structure. Since the transfer material has to be gripped by the gripper, only one transfer material can be carried by one gripper.

In order to solve such a problem, an image forming apparatus has been proposed wherein the transfer material is electrostatically attracted onto the transfer material carrying sheet, and a separation member exclusively for the separating operation is used, by which the necessity for the transfer material gripper is eliminated to permit plural transfer materials to be carried thereon. The transfer material attraction means, as shown in FIG. 6, comprises an attraction charger 33 disposed close to the inside surface of the transfer material carrying sheet 32, a rotatable attraction roller 36 rotatably supported on a shaft 35, which is disposed across the transfer material carrying sheet 32 from the attraction charger 33 and which comprises contact means for contacting to the transfer material carrying sheet 32, a back-up sheet 34 for urging the transfer material carrying sheet 32 to the attraction roller 36 and an attraction guide 37 for guiding the transfer material from the sheet feeding station to an attracting position where the attraction roller 36 contacts the transfer material carrying sheet 32.

When the transfer material is fed out of the sheet feeding station, the attraction roller 36 placed at a stand-by position away from the transfer material carrying sheet 32 is moved by contacting means in the form of a solenoid or the like to an outer surface of the transfer material carrying sheet 32 at the proper timing before the leading edge of the transfer material P reaches the attraction position. At the attracting position, the transfer material P is closely contacted to the transfer material carrying sheet 32 by the attraction roller 36 and the back-up sheet 34, and in addition, it is electrostatically attracted to an outer surface of the transfer material carrying sheet 32 by the discharging of the attraction charger 33. The transfer material P attracted on the transfer material carrying sheet 32 is fed to the transfer station a plurality of times. By the superposed image transfer operations, the plural color toner images are transferred onto the transfer material P from the image bearing member. During this operation, the attraction roller 36 is retracted away from the outer surface of the transfer material carrying sheet 32 to the stand-by position after a predetermined number of sheets fed from the sheet feeding station are attracted and before a leading edge of the transfer material P having received the first color toner image comes again to the attraction position for the second color toner image transfer. The stand-by position is maintained until the next sheet is supplied after completion of the predetermined number of toner image transfer operations.

In the conventional transfer material attracting device, the contacting means for moving the attracting roller toward and away from the transfer material carrying means is operated only during the image transfer sequential operation from the attraction of the transfer material to the separation of the transfer material. More particularly, the attraction roller is brought into contact to the transfer material carrying sheet only upon the attraction of the transfer material with the timing shown in FIG. 3.

When the attraction roller is at the stand-by position away from the outer surface of the transfer material carrying sheet, as shown in FIG. 4, the back-up sheet urges the transfer material carrying sheet. Therefore, when the transfer material carrying sheet does not move, the back-up sheet locally urges the transfer material carrying sheet, with the result of deformation of the transfer material carrying sheet. If this occurs, the attraction efficiency or the transfer efficiency are degraded, in addition, the service life of the transfer material carrying sheet is shortened.

SUMMARY OF THE INVENTION

Accordingly, it is a principal object of the present invention to provide an image forming apparatus wherein the deformation of the recording material carrying member is suppressed.

It is another object of the present invention to provide an image forming apparatus wherein an assisting member is contacted to the recording material carrying member after completion of the image forming operation.

It is a further object of the present invention to provide an image forming apparatus wherein the assisting member is brought into contact with the recording material carrying member upon stoppage of the recording material carrying member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Figure 1:
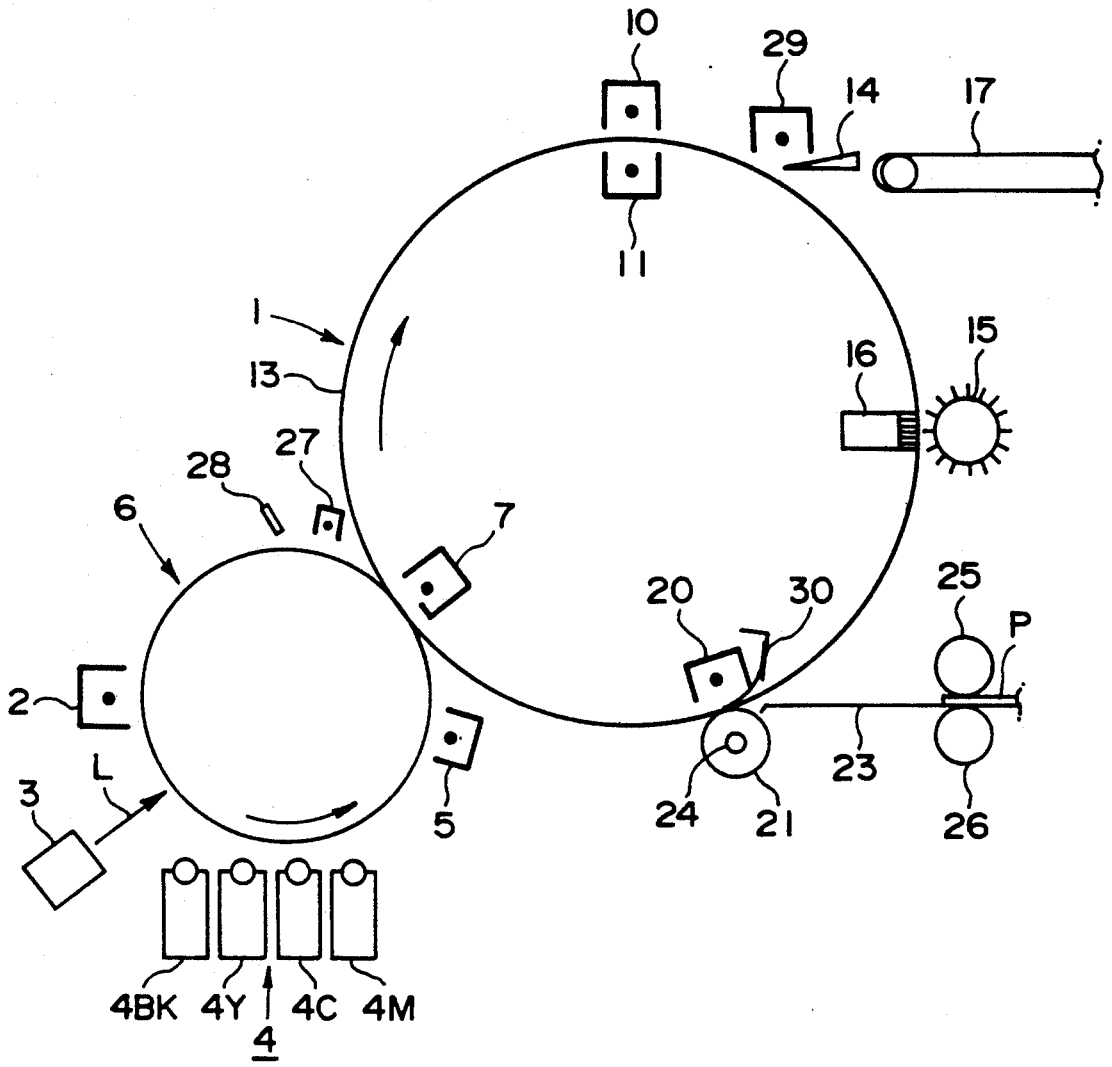
FIG. 1 is a sectional view of an image forming apparatus according to an embodiment of the present invention.

FIG. 1 is a sectional view of an image forming apparatus according to an embodiment of the present invention.

The image forming apparatus is an electrophotographic color copying machine. The color copying machine comprises an image bearing member rotatable in a direction indicated by an arrow, substantially at its center. The image bearing member is in the form of a photosensitive drum 6, around which image forming means are disposed. The image forming means may be of any type, but in this example, it comprises a primary charger 2 for uniformly charging the photosensitive drum 6 an optical system 3 in the form of a laser beam scanning optical system, for example, for exposing the surface of the photosensitive drum 6 to a color separated light image or a beam L corresponding thereto to form an electrostatic latent image on the photosensitive drum 6, a developing device for visualizing the electrostatic latent image on the photosensitive drum 6, and a pre-transfer charger 5, they are arranged in the order named in the direction of the rotation of the photosensitive drum 6.

The developing device 4 in this embodiment is of a type wherein it is horizontally movable in a tangential direction relative to the outer peripheral surface of the photosensitive drum 6. It comprises four developing means 4M, 4C, 4Y and 4BK containing magenta, cyan, yellow and black color developers, for example (dry toner), respectively. The horizontal movement type developing device 4 presents a desired one of the developing means to the outer peripheral surface of the photosensitive drum 6 in response to the color of the light image or the beam L corresponding thereto selected by the optical system 3. Then, the developing means develops the image on the photosensitive drum 6 by electrostatically transferring the developer or the toner, so that a toner image is formed in the selected color.

Figure 5:
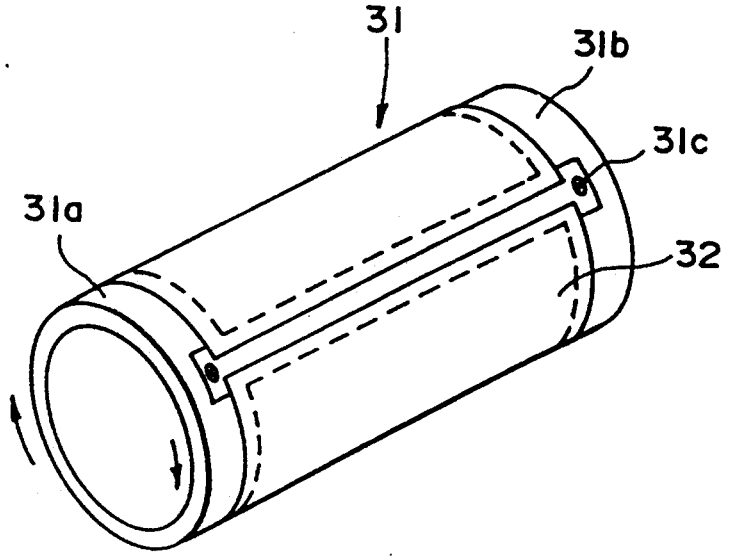
FIG. 5 PRIOR ART
FIG. 5 is a perspective view of an example of an image transfer drum.
Figure 6:
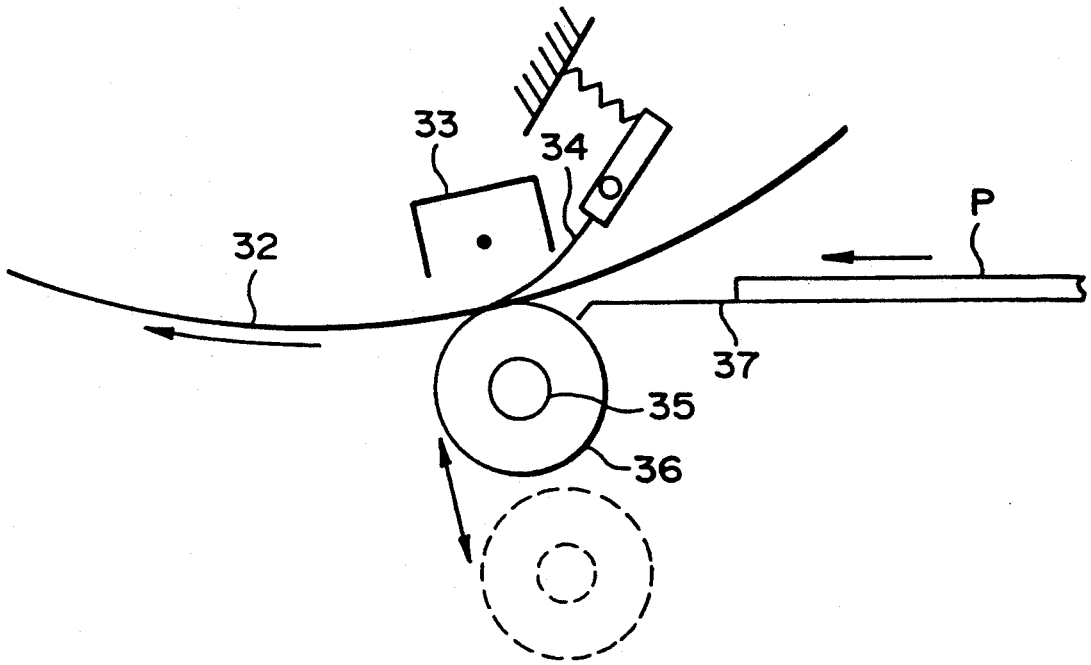
FIG. 6 PRIOR ART
FIG. 6 is a sectional view of an example of a transfer material attracting device in a conventional image forming apparatus.

The toner image formed on the photosensitive drum 6 is transferred onto a transfer material P conveyed on a recording material carrying member 1. In this embodiment, the recording material carrying member 1 is in the form of a rotatable transfer drum. The transfer drum 1 is disposed downstream of the developing device 4 with respect to the rotational direction of the photosensitive drum 6, and is contacted to the photosensitive drum 6 or faced thereto with a small clearance. The transfer drum 1 may be of any known type in an image forming apparatus. FIG. 5 shows an example wherein it comprises a pair of axially spaced ring members, a connecting member for connecting them, a dielectric sheet 13 covering the opening defined by the ring members and the connecting member. At an image transfer position faced to the photosensitive drum 6, there is disposed a transfer corona charger 7 faced to the photosensitive drum 6 through the transfer material carrying sheet 13.

The transfer drum 1 is rotated in the direction indicated by an arrow. Upstream of the transfer position where the corona charger 7 is disposed, there is an attraction corona charger 20 facing to the backside of the transfer material carrying sheet 13, and there is an attraction roller (assisting member for assisting carrying of the recording material on the carrying member) 21 faced to the attraction corona charger 20 through the transfer material carrying sheet 13 therebetween. The attraction roller 21 is disposed below the transfer drum 1 and is rotatably supported on a shaft 24. It is movable to and away from the transfer material carrying sheet 13. The movement is provided by moving means in the form of solenoid (not shown) or the like.

Downstream of the transfer position, there are two corona dischargers 10 and 11 which are disposed sandwiching the transfer material carrying sheet 13 to effect electric discharging action. Downstream thereof, there is a separation blade 14 for separating the transfer material P from the transfer material carrying sheet 13. The blade 14 is disposed to the recording material carrying side of the sheet 13. Further downstream, there are a brush roller 15 for cleaning the recording material carrying side of the carrying sheet 13 and, if necessary, a corona discharger or a brush discharger 16 for removing attraction force (coulomb force and Van Der Walls force).

Adjacent to the transfer drum 1, an image fixing device (not shown) comprising a pair of fixing rollers is disposed. The fixing device functions to fix the unfixed toner image on the transfer material P which has been separated from the transfer material carrying sheet 13 by a separation blade 14 and conveyed on a conveyer 17.

Around the photosensitive drum 6, as shown in FIG. 1, there are a discharger 27 for removing electrostatic charge from the surface of the photosensitive drum 6 and a cleaning blade 28 for removing residual toner particles. If desired, a corona discharger 29 disposed adjacent the separation blade 14 so as to prevent disturbance of the image due to separation discharge occurring when the transfer material P is separated from the transfer material carrying sheet 13. The corona discharger 29 effects AC corona discharging. Immediately upstream of the attraction corona charger 20 and the attraction roller 21, there is an attraction guide 23 which is effective to guide the transfer material P fed out of the sheet feeding station to an attraction position where the attracting roller 21 and the transfer material carrying sheet 13 are contacted, by way of a pair of registration rollers 25 and 26.

In this embodiment, an urging means 30 made of elastic material such as elastic sheet having a thickness of 150 microns, for example, is disposed within the transfer material carrying sheet 13 at a position facing to the attracting roller 21. It functions to urge and support the transfer material carrying sheet 13 from the inside so as to prevent the inward deformation of the transfer material carrying sheet 13 and to assure the close contact of the transfer material carrying sheet 13 to the transfer material P upon the attraction thereof.

In operation, the surface of the photosensitive drum 6 is uniformly charged by the primary charger 2 and is exposed to a color image through a green filter, for example, by the optical system 3, so that an electrostatic latent image of magenta component is formed. In synchronism with the latent image formation, the developing device 4 is moved in the horizontal direction to present the proper developing means in the developing position. More particularly, the developing means 4M containing the magenta developer is faced to the photosensitive drum 6, so that a magenta toner image is formed on the photosensitive drum 1.

On the other hand, the transfer material P is fed out to the attraction guide 23 at the timing determined by the registration rollers 25 and 26, and is fed along a surface (carrying surface) of the transfer material carrying sheet 13 to an attracting position where the attraction roller 21 is disposed. In the attracting position, there is an urging means 30 made of elastic sheet having a thickness of 150 microns, for example to urge the sheet 13 to prevent the inward deformation of the sheet 13 and also to closely contact the transfer material P to the sheet 13.

The transfer material P conveyed to the attraction position in this manner is attracted and supported on the carrying member 13 by electrostatic force resulting from the operation of the corona charger 20 and is fed to the transfer position where it is faced to the transfer drum 6.

In this transfer position, the transfer corona charger 7 is operated so that an image transfer electric field is generated to apply the proper polarity electric charge to the transfer material carrying sheet 13, by which the toner image is transferred from the photosensitive drum 6 to the transfer material P. At the time when the trailing edge of the transfer material P passes by the attraction roller 21, the attraction roller 21 is moved away from the transfer material carring sheet 13 to the retracted or stand-by position by moving means (not shown) including a solenoid. By doing so, when the transfer material P moves through the attraction position again for the second and subsequent toner image transfers, the attraction roller 21 is prevented from contacting to an unfixed toner image or images already transferred onto the transfer material P. Therefore, the toner image or images are not scraped off.

This is advantageous also in the case wherein only one color toner image is transferred onto the transfer material. For example, when the transfer material having the unfixed toner image is passed by the attraction position, for example, when the transfer material separating position is disposed between the attracting position and the image transfer position, the attraction roller moving means is effective to prevent the attraction roller from scraping the unfixed toner image or images off the transfer material.

In the case of the full-color copy or multi-color copy, after completion of the superposed toner image transfers in the magenta, cyan, yellow and black colors, the transfer material P is separated from the transfer material carrying sheet by two corona dischargers 10 and 11, the corona discharger 29 disposed as desired, and by a separating blade 14. The transfer material is then carried to the fixing devices.

In the fixing device, the laminated plural color toner images are fixed on the transfer material by heat and or pressure into a mixed color image in the case of full-color copy. After completion of a sequential image forming operations, the transfer drum 1 and the photosensitive drum 6 stop. With the stoppage of the transfer drum 1, the attraction roller 21 is again moved to the transfer material carrying sheet again to contact it by the attraction solenoid.

Figure 2:
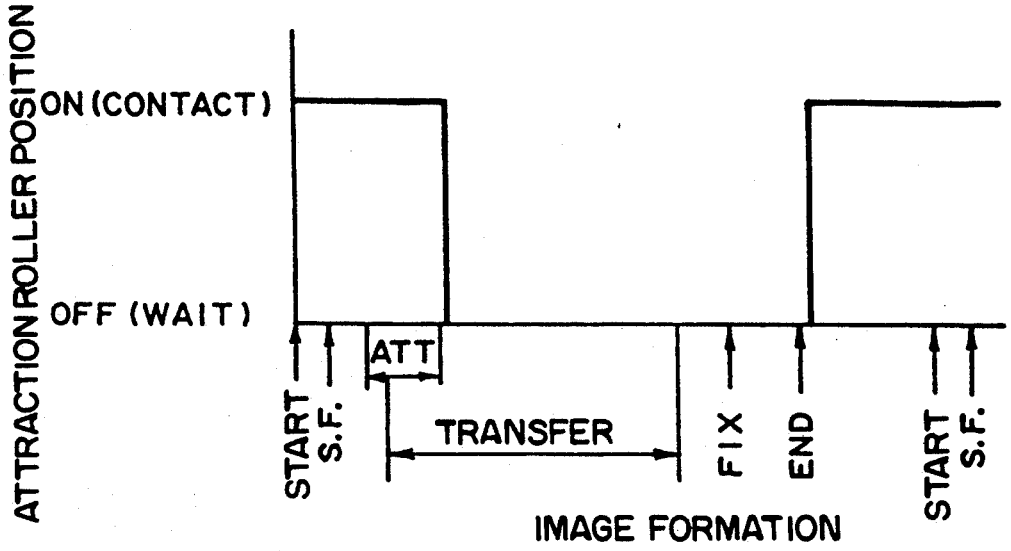
FIG. 2 is a timing chart of operations of the attraction roller according to an embodiment of the present invention.
Figure 3:
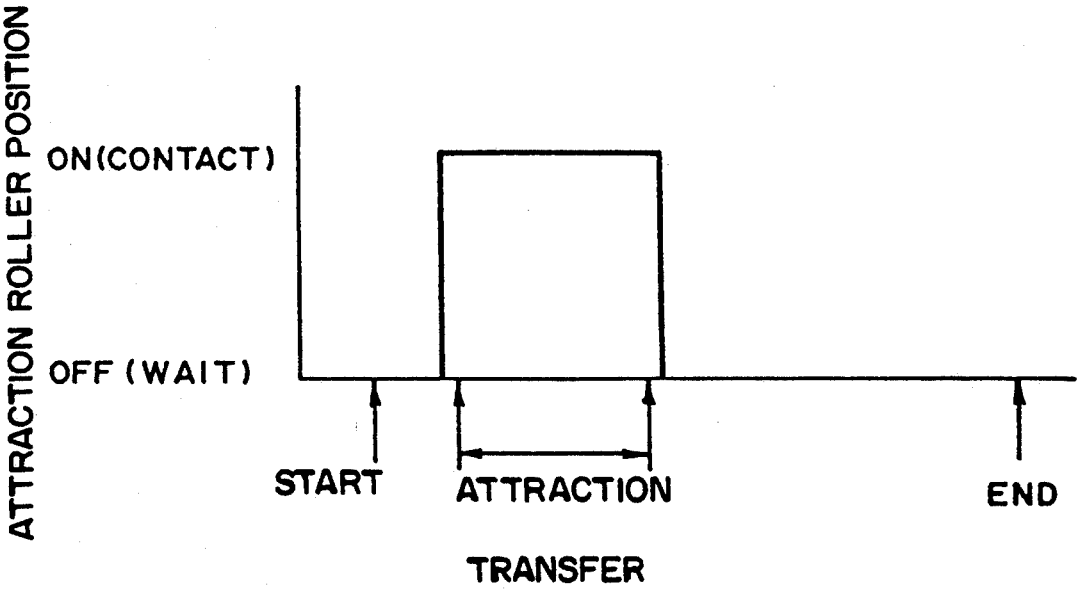
FIG. 3 PRIOR ART
FIG. 3 is a timing chart of the operations of the attraction roller in a conventional image forming apparatus.
Figure 4:
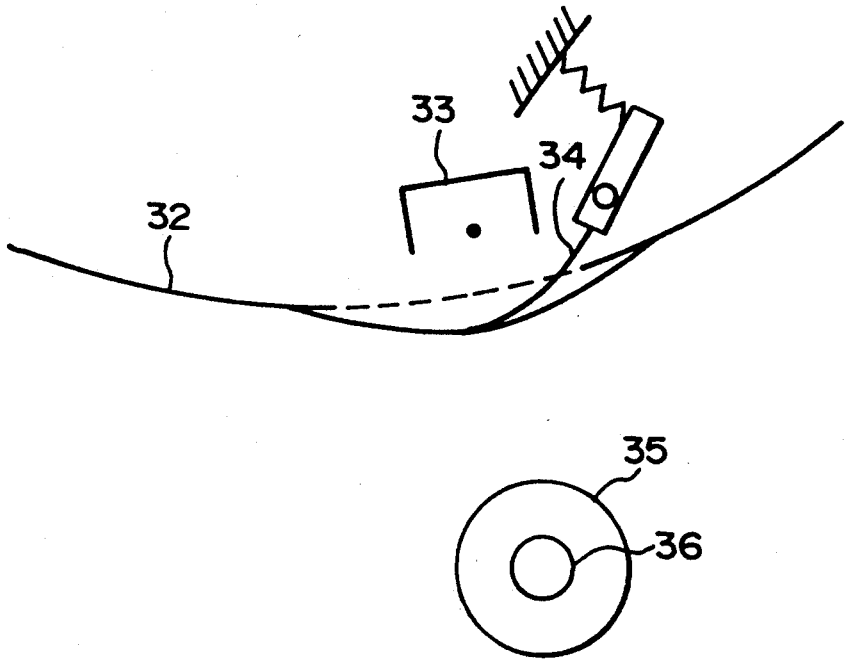
FIG. 4 PRIOR ART
FIG. 4 is a sectional view of major elements in the attracting position in a conventional image forming apparatus, when its transfer drum is not moved.

FIG. 2 shows the operational timing of the attraction roller 21, in which the abscissa represents the time of the image formation operation, and the coordinate represents the position of the attracting roller. It deals with the mode in which one image forming operation is carried out in response to one image formation instructing signal. As will be understood from FIG. 2, in this embodiment, the attraction roller is kept in contact with the transfer material carrying sheet after completion of one image forming operation until the transfer material is attracted to the transfer material carrying sheet after start of the next image forming operation. In the continuous mode wherein plural images are formed in response to one copy instruction signal, the attraction roller 21 is contacted to the transfer material carrying sheet 13 at the timing in which the transfer material P is fed to the transfer position. After the completion of the last image forming operation, the attraction roller is operated at the timing shown in FIG. 2.

As described in the foregoing, according to the present invention, the attraction roller 21 is contacted to the transfer material carrying sheet 13 after completion of the image forming operation, and therefore, even if the transfer material carrying sheet 13 is urged outwardly by the urging means 30 for a relatively long period after the completion of the image transfer operation, the transfer material carrying sheet 13 is prevented from deforming toward outside because of the contact thereto by the attraction roller 21. Particularly, in this embodiment, the attraction roller is contacted to the transfer drum when the transfer drum is at rest, and therefore, the deformation can be prevented which is otherwise caused in the transfer material carrying sheet by the locally applied force.

Upon the start of the image forming operation, the attracting roller 21 is contacted to the transfer material carrying sheet 13, and therefore, the movement of the attraction roller 21 can be omitted upon the next attracting operation for the transfer material.

In the foregoing embodiment, the attraction roller is brought into contact to the transfer material carrying means after completion of the image forming operation including the fixing operation. However, the attraction roller may be contacted to the transfer material carrying sheet at any time after the transfer material carrying the unfixed toner image becomes absent in the attracting position (at this time, the transfer drum continues to rotate, and the unfixed toner image is not completely fixed).

In the foregoing embodiment, the attraction roller is kept contacted to the transfer material carrying means until the completion of the attracting operation for the next transfer material. However, the deformation of the transfer material carrying sheet may be suppressed by contacting it for a predetermined period after the completion of the image formation or by intermittently contacting it to the transfer material carrying sheet.

In the foregoing embodiment, an electrophotographic color copying machine is taken, but the present invention is applicable to another image forming apparatus such as electrophotographic or electrostatic printer or copying machines.

The present invention is particularly suitable when the transfer material is supported on the transfer material carrying means at a fixed position thereof for all of the sheets, since then the possibility of the deformation of the transfer material carrying sheet is significant.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:
an image bearing member;
a recording material carrying member for carrying a recording material, said carrying member including a sheet for carrying the recording material;
image transfer means for transferring an image from said image bearing member to the recording material carried on said recording material carrying member;
an assisting member for assisting at a carrying position the recording material to be carried on said recording material carrying member, said assisting member being movable to and away from said sheet; and charging means disposed with said sheet between said charging means and said assisting member, said charging means for attracting the recording material to said sheet,
wherein said assisting member contacts said sheet for at least a part of a period in which an image transfer operation is being completed, which is after the recording material passes by said carrying position and which is before a next recording material is carried on said carrying member.

2. An apparatus according to claim 1, wherein said assisting member keeps in contact with said sheet during a period in which an image transfer operation is being completed, which is after the recording material passes by said carrying position and which is before a next recording material is carried on said carrying member.

3. An apparatus according to claim 1, further comprising an urging member for urging the sheet, said urging member and said assisting member sandwiches the sheet.

4. An apparatus according to claim 3, wherein said urging member is at a position faced to said assisting member.

5. An apparatus according to claim 3, wherein said urging member is an elastic sheet.

6. An apparatus according to claim 3, wherein when said assisting member contacts said sheet, said urging member contacts said sheet.

7. An apparatus according to claim 1, wherein when said recording material carrying member is at rest, said assisting member is in contact with said sheet.

8. An apparatus according to claim 1, wherein when the recording material from a sheet supply station is carried on said recording material carrying member, said assisting member urges the recording material to said sheet, and after a trailing edge of the recording material is carried on said recording material carrying member, said assisting member is separated from said sheet.

9. An apparatus according to claim 1, wherein said assisting member is in the form of a roller.

10. An apparatus according to claim 1, wherein said apparatus is capable of forming plural color toner images on said image bearing member, and the toner images are sequentially transferred onto the recording material carried on said recording material carrying member.

11. An apparatus according to claim 10, wherein the toner images include yellow, magenta, cyan and black toner images, which are fixed by image fixing means into a full-color image on the recording material.

12. An apparatus according to claim 1, wherein said recording material carrying member is in the form of a rotatable drum.

13. An apparatus according to claim 3, wherein said urging member is disposed inside of said recording material carrying member.

14. An apparatus according to claim 13, wherein said assisting member is disposed below said recording material carrying member.

15. An apparatus according to claim 1, wherein said assisting member contacts said sheet at least a part of a period which is after the image is fixed on the recording material and which is before a next recording material is carried on said carrying member.

16. An apparatus according to claim 15, wherein said assisting member keeps in contact with said sheet during a period which is after the image is fixed on the recording material and which is before a next recording material is carried on said carrying member.

17. An image forming apparatus, comprising:
an image bearing member;
a recording material carrying member for carrying a recording material, said carrying member including a sheet for carrying the recording material;
image transfer means for transferring an image from said image bearing member to the recording material carried on said recording material carrying member;
an assisting member for assisting the recording material to be carried on said recording material carrying member, said assisting member being movable to and away from said sheet; and
charging means disposed with said sheet between said charging means and said assisting member, said charging means for attracting the recording material to said sheet,
wherein said assisting member is in contact with said sheet when said recording material carrying member is at rest.

18. An apparatus acc to claim 17, wherein said recording material carrying member stops after completion of the image transfer operation.

19. An apparatus according to claim 17, wherein said recording material carrying member is rotatable.

20. An apparatus according to claim 17, further comprising an urging member for urging the sheet, said urging member and said assisting member sandwiches the sheet.

21. An apparatus according to claim 17, wherein said urging member is at a position faced to said assisting member.

22. An apparatus according to claim 17, wherein said urging member is an elastic sheet.

23. An apparatus according to claim 17, wherein when the recording material from a sheet supply station is carried on said recording material carrying member, said assisting member urges the recording material to said sheet, and after a trailing edge of the recording material is carried on said recording material carrying member, said assisting member is separated from said recording material carrying member.

24. An apparatus according to claim 17, wherein said assisting member is in the form of a roller.

25. An apparatus according to claim 17, wherein said apparatus is capable of forming plural color toner images on said image bearing member, and the toner images are sequentially transferred onto the recording material carried on said recording material carrying member.

26. An apparatus according to claim 27, wherein the toner images include yellow, magenta, cyan and black toner images, which are fixed by image fixing means into a full-color image on the recording material.

27. An apparatus according to claim 17, wherein said recording material carrying member is in the form of a drum.

28. An apparatus according to claim 20, wherein said urging member is disposed inside of said recording material carrying member.

29. An apparatus according to claim 27, wherein said assisting member is disposed below said recording material carrying member.

30. An image forming apparatus, comprising:

an image bearing member;

a recording material carrying member for carrying a recording material, said carrying member including a sheet for carrying the recording material;

image transfer means for transferring an image from said image bearing member to the recording material carried on said recording material carrying member; and an assisting member for assisting at a carrying position attraction of the recording material to said recording material carrying member, said assisting member being movable to and away from said sheet, wherein when the recording material from a sheet supply station is carried on said recording material carrying member, said assisting member urges the recording material toward said sheet, and after a trailing edge of the recording material is carried on said recording material carrying member past said assisting member, said assisting member is separated from said sheet;

wherein said assisting member contact said sheet at least a part of a period in which an image transfer operation is being completed, which is after the recording material passes by said carrying position and which is before a next recording material is carried on said carrying member.

31. An apparatus according to claim 30, wherein said assisting member remains in contact with said sheet during a period in which an image transfer operation is being completed, which is after the recording material passes by said carrying position and which is before a next recording material is carried on said carrying member.

32. An apparatus according to claim 30, further comprising an urging member for urging the sheet, said urging member and said assisting member sandwiches the sheet.

33. An apparatus according to claim 32, wherein said urging member is at a position opposing said assisting member.

34. An apparatus according to claim 32, wherein said urging member is an elastic sheet.

35. An apparatus according to claim 30, wherein said assisting member is in the form of a roller.

36. An apparatus according to claim 30, wherein said apparatus is capable of forming plural color toner images on said image bearing member, and the toner images are sequentially transferred onto the recording material carried on said recording material carrying member.

37. An apparatus according to claim 36, wherein the toner images include yellow, magenta, cyan and black toner images, which are fixed by image fixing means into a full-color image on the recording material.

38. An apparatus according to claim 30, wherein said recording material carrying member is in the form of a rotatable drum.

39. An apparatus according to claim 32, wherein said urging member is disposed inside of said recording material carrying member.

40. An apparatus according to claim 39, wherein said assisting member is disposed below said recording material carrying member.

41. An apparatus according to claim 30, wherein said assisting member contacts said sheet at least a part of a period which is after the image is fixed on the recording material and which is before a next recording material is carried on said carrying member.

42. An apparatus according to claim 41, wherein said assisting member remains in contact with said sheet during a period which is after the image is fixed on the recording material and which is before a next recording material is carried on said carrying member.

43. An apparatus according to claim 30, wherein when said recording material carrying member is at rest, said assisting member is in contact with said sheet.

44. An apparatus according to claim 32, wherein when said assisting member contact said sheet, said urging member contacts said sheet.

45. An image forming apparatus, comprising:

an image bearing member;

a recording material carrying member for carrying a recording material, said carrying member including a sheet for carrying the recording material;

image transfer means for transferring an image from said image bearing member to the recording material carried on said recording material carrying member;

an assisting member for assisting said recording material carrying member to carry the recording material, said assisting member being movable to and away from said sheet, wherein when the recording material from a sheet supply station is carried on said recording material carrying member, said assisting member urges the recording material to said sheet, and after a trailing edge of the recording material is carried on said recording material carrying member, said assisting member is separated from said sheet;

wherein said assisting member is in contact with said sheet when said recording material carrying member is at rest.

46. An apparatus according to claim 45, wherein said recording material carrying member stops after completion of the image transfer operation.

47. An apparatus according to claim 45, wherein said recording material carrying member is rotatable.

48. An apparatus according to claim 45, further comprising an urging member for urging the sheet, the sheet being between said urging member and said assisting member.

49. An apparatus according to claim 48, wherein said urging member is at a position opposing said assisting member.

50. An apparatus according to claim 48, wherein said urging member is an elastic sheet.

51. An apparatus according to claim 45, wherein said assisting member is in the form of a roller.

52. An apparatus according to claim 45, wherein said apparatus includes means for forming plural color toner images on said image bearing member, whereby the toner images are sequentially transferred onto the recording material carried on said recording material carrying member.

53. An apparatus according to claim 52, wherein the toner images include yellow, magenta, cyan and black toner images, which are fixed by image fixing means into a full-color image on the recording material.

54. An apparatus according to claim 45, wherein said recording material carrying member is in the form of a drum.

55. An apparatus according to claim 48, wherein said urging member is disposed inside of said recording material carrying member.

56. An apparatus according to claim 55, wherein said assisting member is disposed below said recording material carrying member.

57. An image forming apparatus, comprising:

an image bearing member;

a recording material carrying member for carrying a recording material, said carrying member including a sheet for carrying the recording material;

image transfer means for transferring an image from said image bearing member to the recording material carried on said recording material carrying member;

an assisting member for assisting at a carrying position the carrying of the recording material on said recording material carrying member, said assisting member being movable to and away from said sheet; and an urging member, disposed on an opposite side of said sheet from said assisting member and inside said recording material carrying member, for urging said sheet, wherein said assisting member contacts said sheet at least a part of a period in which an image transfer operation is being completed, which is after the recording material passes by said carrying position and which is before a next recording material is carried on said carrying member.

58. An apparatus according to claim 57, wherein said assisting member remains in contact with said sheet during a period in which an image transfer operation is being completed, which is after the recording material passes by said carrying position and which is before a next recording material is carried on said carrying member.

59. An apparatus according to claim 57, wherein said urging member is an elastic sheet.

60. An apparatus according to claim 57, wherein said assisting member is in the form of a roller.

61. An apparatus according to claim 57, wherein said apparatus includes means for forming plural color toner images on said image bearing member, and the toner images are sequentially transferred onto the recording material carried on said recording material carrying member.

62. An apparatus according to claim 61, wherein the toner images include yellow, magenta, cyan and black toner images, which are fixed by image fixing means into a full-color image on the recording material.

63. An apparatus according to claim 57, wherein said recording material carrying member is in the form of a rotatable drum.

64. An apparatus according to claim 57, wherein said assisting member is disposed below said recording material carrying member.

65. An apparatus according to claim 57, wherein said assisting member contacts said sheet at least a part of a period which is after the image is fixed on the recording material and which is before a next recording material is carried on said carrying member.

66. An apparatus according to claim 65, wherein said assisting member remains in contact with said sheet during a period which is after the image is fixed on the recording material and which is before a next recording material is carried on said carrying member.

67. An apparatus according to claim 57, wherein when said recording material carrying member is at rest, said assisting member is in contact with said sheet.

68. An apparatus according to claim 57, wherein when said assisting member contacts said sheet, said urging member contacts said sheet.

69. An image forming apparatus, comprising:

an image bearing member;

a recording material carrying member for carrying a recording material, said carrying member including a sheet carrying the recording material;

image transfer means for transferring an image from said image bearing member to the recording material carried on said recording material carrying member;

an assisting member for assisting carrying of the recording material on said recording material carrying member, said assisting member being movable to and away from said sheet;

an urging member, disposed across said sheet from said assisting member and inside said recording material carrying member, for urging said sheet;

wherein said assisting member is in contact with said sheet when said recording material carrying member is at rest.

70. An apparatus according to claim 69, wherein said recording material carrying member stops after completion of the image transfer operation.

71. An apparatus according to claim 69, wherein said recording material carrying member is rotatable.

72. An apparatus according to claim 69, wherein said urging member is an elastic sheet.

73. An apparatus according to claim 69, wherein said assisting member is in the form of a roller.

74. An apparatus according to claim 69, wherein said apparatus includes means for forming plural color toner images on said image bearing member, and the toner images are sequentially transferred onto the recording material carried on said recording material carrying member.

75. An apparatus according to claim 74, wherein the toner images include yellow, magenta, cyan and black toner images, which are fixed by image fixing means into a full-color image on the recording material.

76. An apparatus according to claim 69, wherein said recording material carrying member is in the form of a drum.

77. An apparatus according to claim 69, wherein said assisting member is disposed below said recording material carrying member.

* * * * *

UNITED STATES PATENT AND TRADEMARK OFFICE

CERTIFICATE OF CORRECTION

PATENT NO.: 5,239,347

DATED: August 24, 1993

INVENTOR(s): Shinichi ONODERA, et al

It is certified that error appears in the above-indentified patent and that said Letters Patent is hereby corrected as shown below:

Column 3

Line 46, "developing device" should read --developing device 4--.

Line 48, "charger 5, they" should read --charger 5. They--.

Column 7

Line 52, "sandwiches" should read --sandwiching--.

Column 8

Line 57, "acc" should read --according--,

Line 64, " sandwiches" should read --sandwiching--,

Line 66, "claim 17," should read --claim 20,--.

Column 9

Line 1, "claim 17," should read --claim 20,--,

Line 19, "claim 27," should read --claim 25,--,

Line 29, "claim 27," should read --claim 28,--,

Line 54, "contact" should read --contacts--.

UNITED STATES PATENT AND TRADEMARK OFFICE

CERTIFICATE OF CORRECTION

PATENT NO.: 5,239,347

DATED: August 24, 1993

INVENTOR(s): Shinichi ONODERA, et al

It is certified that error appears in the above-indentified patent and that said Letters Patent is hereby corrected as shown below:

Column 10

Line 1, "sandwiches" should read --sandwiching--,
Line 44, "contact" should read --contacts--,
Line 54, "member;" should read --member; and--.

Signed and Sealed this

Twenty-first Day of June, 1994

Bruce Lehman

*Attest:*

BRUCE LEHMAN

*Attesting Officer*

*Commissioner of Patents and Trademarks*